US007856830B2

(12) United States Patent
Alkabie

(10) Patent No.: US 7,856,830 B2
(45) Date of Patent: Dec. 28, 2010

(54) NOISE REDUCING COMBUSTOR

(75) Inventor: Hisham Alkabie, Oakville (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1038 days.

(21) Appl. No.: 11/441,225

(22) Filed: May 26, 2006

(65) Prior Publication Data

US 2007/0271926 A1 Nov. 29, 2007

(51) Int. Cl.
*F23R 3/06* (2006.01)
*F23R 3/54* (2006.01)

(52) U.S. Cl. ..... 60/804; 60/754; 60/600

(58) Field of Classification Search ..... 60/804, 60/752, 754, 755, 756, 757, 600
See application file for complete search history.

(56) References Cited

U.S. PATENT DOCUMENTS

| | | | | |
|---|---|---|---|---|
| 2,654,219 | A | 10/1953 | Zaba | |
| 4,422,300 | A | 12/1983 | Dierberger et al. | |
| 4,695,247 | A | 9/1987 | Enzaki et al. | |
| 5,184,455 | A | 2/1993 | Ewing et al. | |
| 5,216,886 | A | 6/1993 | Ewing | |
| 5,241,827 | A * | 9/1993 | Lampes | 60/754 |
| 5,435,139 | A | 7/1995 | Pidcock et al. | |
| 5,528,904 | A | 6/1996 | Jones et al. | |
| 5,590,531 | A * | 1/1997 | Desaulty et al. | 60/752 |
| 5,598,697 | A | 2/1997 | Ambrogi et al. | |
| 5,687,572 | A | 11/1997 | Schrantz et al. | |
| 5,758,504 | A | 6/1998 | Abreu et al. | |
| 6,105,371 | A * | 8/2000 | Ansart et al. | 60/754 |
| 6,282,905 | B1 | 9/2001 | Sato et al. | |
| 6,330,791 | B1 | 12/2001 | Kendall et al. | |
| 6,351,947 | B1 | 3/2002 | Keller et al. | |
| 6,513,331 | B1 * | 2/2003 | Brown et al. | 60/754 |
| 6,530,221 | B1 | 3/2003 | Sattinger et al. | |
| 6,546,731 | B2 | 4/2003 | Alkabie et al. | |
| 6,640,544 | B2 | 11/2003 | Suenaga et al. | |
| 6,698,206 | B2 | 3/2004 | Scarinci et al. | |
| 6,955,053 | B1 * | 10/2005 | Chen et al. | 60/804 |
| 6,964,170 | B2 | 11/2005 | Alkabie | |
| 7,546,737 | B2 * | 6/2009 | Schumacher et al. | 60/754 |
| 2004/0060295 | A1 | 4/2004 | Mandai et al. | |
| 2004/0211188 | A1 * | 10/2004 | Alkabie | 60/772 |
| 2006/0042263 | A1 | 3/2006 | Patel et al. | |
| 2006/0042271 | A1 | 3/2006 | Morenko et al. | |
| 2006/0196188 | A1 * | 9/2006 | Burd et al. | 60/754 |

* cited by examiner

*Primary Examiner*—Ted Kim
(74) *Attorney, Agent, or Firm*—Ogilvy Renault LLP

(57) ABSTRACT

A combustor having liners with a plurality of angled effusion holes defined therethrough at a first angle with respect to a surface of the liners and at a second angle with respect to a corresponding radial plane. A density of the effusion holes defined in a primary section receiving the fuel nozzles is at least equal to a density of the effusion holes defined in a secondary downstream section.

7 Claims, 5 Drawing Sheets

NOISE REDUCING COMBUSTOR

TECHNICAL FIELD

The invention relates generally to gas turbine engines and, more particularly, to an improved combustor for such engines providing low noise levels.

BACKGROUND OF THE ART

Noise produced by gas turbine engines is largely caused by pressure and acoustic vibrations which can occur in and around the combustion chamber under certain conditions. Many advancements have been made to reduce the overall noise levels generated by gas turbine engines. However, few have enabled the reduction of noise generated by the combustion chamber of such a gas turbine engine.

In some cases, the noise of the combustion chamber is damped by providing Helmholtz resonators as damping elements to eliminate undesirable vibrations, which contribute to noise levels. However, combustors incorporating Helmholtz resonators are generally complex to manufacture.

In other cases, the combustors have a double wall construction, i.e. interconnected inner walls defining the combustion chamber surrounded by interconnected outer walls to define an annular free space therebetween. The outer walls have impingement holes defined therein which permit compressed air from around the combustion chamber to pass through to impinge on the inner walls. The inner walls have effusion holes defined therein to permit the air to effuse into the combustion chamber. However such a design generally permits the reduction of only a specific range of noise frequencies. In addition, the double wall construction generally renders the combustor more complex and costly to manufacture.

Accordingly, improvements are desirable.

SUMMARY OF THE INVENTION

It is therefore an object of this invention to provide an improved gas turbine engine combustor enabling noise reduction.

In one aspect, the present invention provides a combustor for a gas turbine engine, the combustor comprising inner and outer liners defining an annular combustion chamber therebetween, the combustion chamber having a primary section adapted to receive a plurality of fuel nozzles and a secondary section defined downstream of the primary section, the liners having a plurality of angled effusion holes defined therethrough in the primary and secondary sections, each of the effusion holes being defined through a corresponding one of the liners at a first angle with respect to a surface of the corresponding one of the liners and at a second angle with respect to a corresponding radial plane extending radially from a central axis of the combustor, a density of the effusion holes defined in the primary section being at least equal to a density of the effusion-holes defined in the secondary section.

In another aspect, the present invention provides a method of reducing noise emissions of a gas turbine engine, the method comprising introducing an effusion airflow from a compressor section of the engine through a wall of a combustor of the engine, and directing the effusion airflow along a direction extending at a first angle with respect to a surface of the wall and at a second angle with respect to a radial plane extending radially from a central axis of the combustor to produce a time delay between a noise generated in the compressor section and at least one of a noise generated in the combustor and a noise amplified in the combustor.

In a further aspect, the present invention provides a method of manufacturing a combustor for reducing noise emissions in a gas turbine engine, the method comprising selecting a first effusion hole density for a primary combustion section of the combustor according to a desired frequency range of the noise emissions to be attenuated, selecting a second effusion hole density for a remaining section of the combustor, the second density being smaller than the first density, and defining effusion holes through walls of the combustor following hole directions angled with respect to a corresponding one of the walls and to a respective radial plane extending radially from a central axis of the combustor, the effusion holes being defined in the primary section according to the first density and in the remaining section according to the second density.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
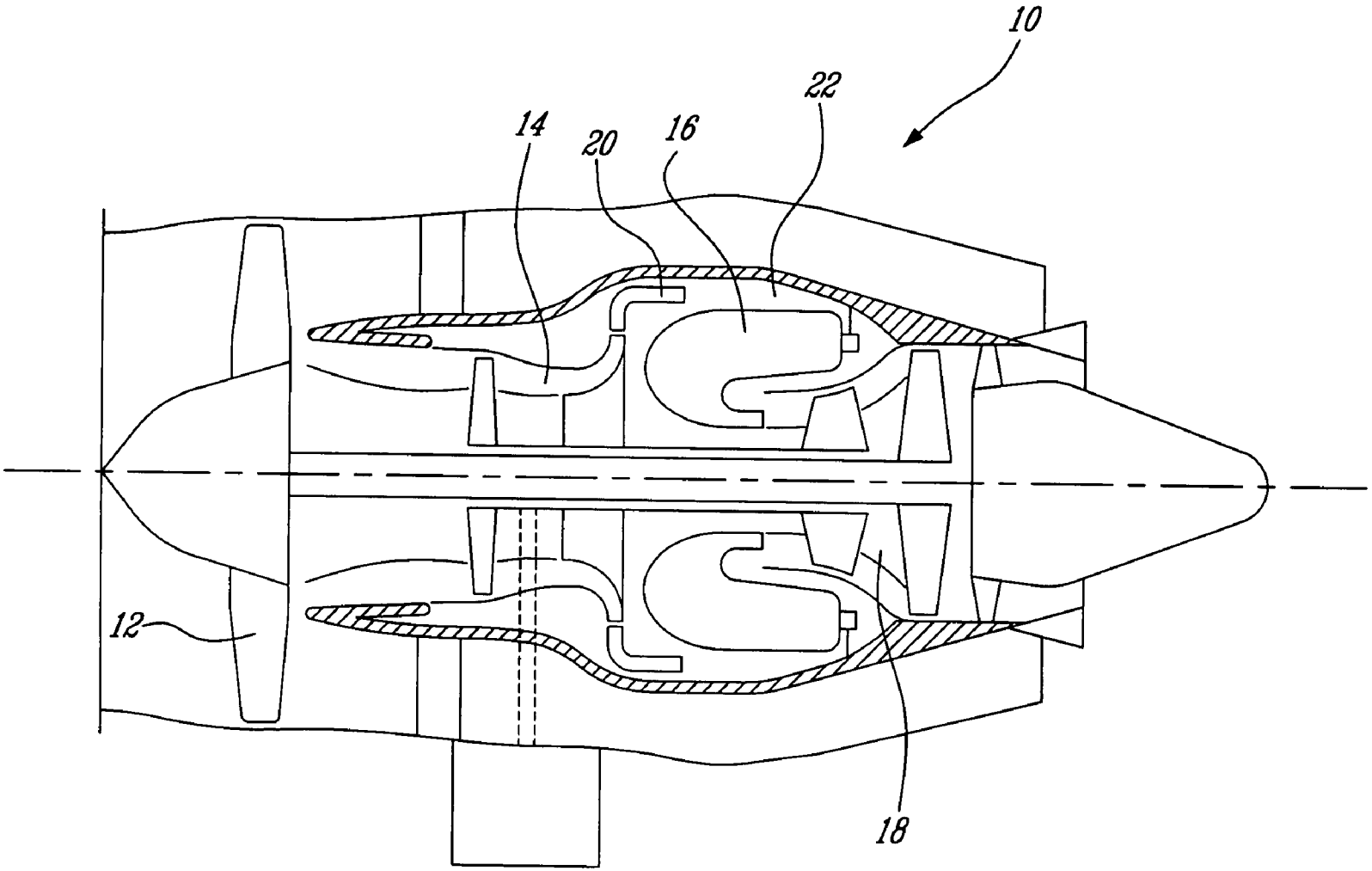
FIG. 1 is a schematic, cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
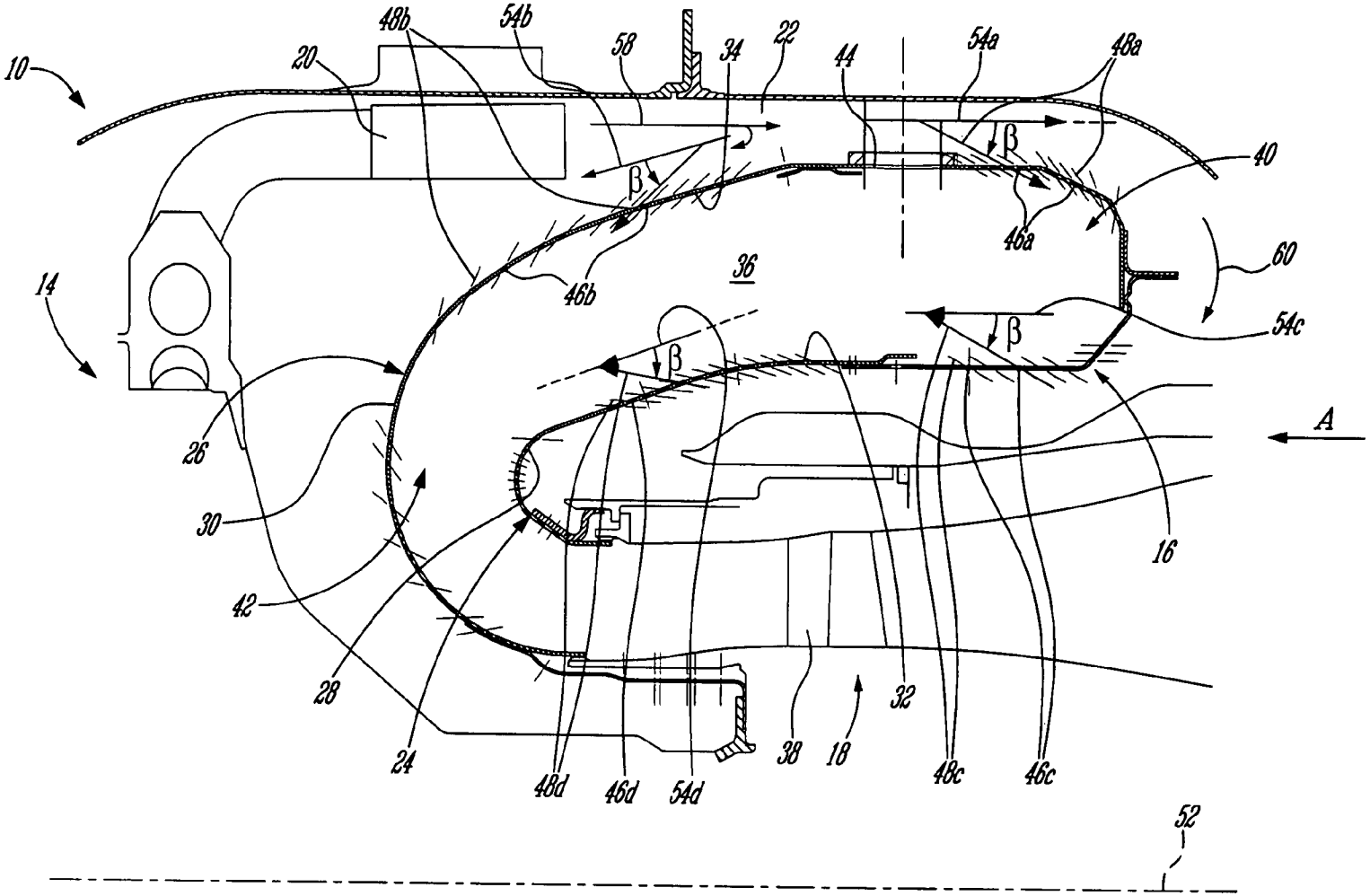
FIG. 2 is a cross-sectional view of part of the gas turbine engine of FIG. 1, including a combustor according to a particular embodiment of the present invention.

Referring to FIG. 2, the air exiting the compressor 14 passes through a diffuser 20 and enters a gas generator case 22 which surrounds the combustor 16. The combustor 16 includes interconnected inner and outer annular walls or liners 24, 26 connected by a combustor dome which receive the airflow circulating in the gas generator case on outer surfaces 28, 30 thereof, and which define an annular enclosure or combustion chamber 36 between inner surfaces 32, 34 thereof. The annular stream of hot combustion gases travels through the combustion chamber 36 and passes through an array of compressor turbine (CT) vanes 38 upon entering the turbine section 18.

The combustor 16 includes a primary or combustion section 40, where the fuel nozzles (not shown) are received, and an intermediate and dilution section 42, which is defined downstream of the primary section 40. The outer liner 26 has a series of fuel nozzle holes 44 (also shown in FIG. 3A) defined therein in the primary section 4G, each hole 44 being adapted to receive a fuel nozzle (not shown). The primary section 40 is the region in which the chemical reaction of combustion is completed, and has the highest flame temperature within the combustor. The downstream section 42 has a secondary zone characterized by first additional air jets to quench the hot product generated by the primary section; and a dilution zone where second additional jets quench the hot product and profile the hot product prior to discharge to turbine section.

Figure 3A:
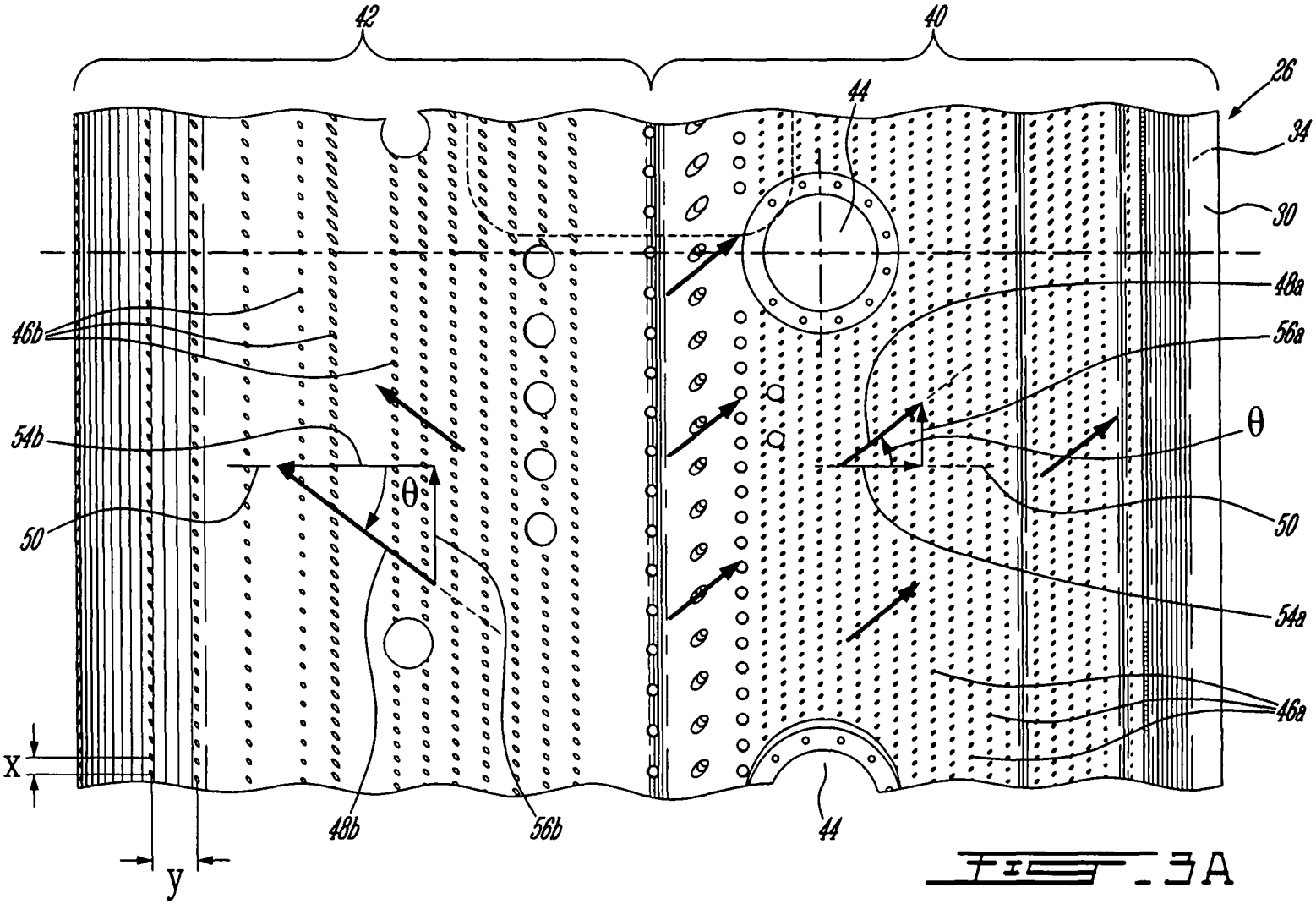
FIG. 3A is a top view of a portion of an outer liner of the combustor of FIG. 2.
Figure 3B:
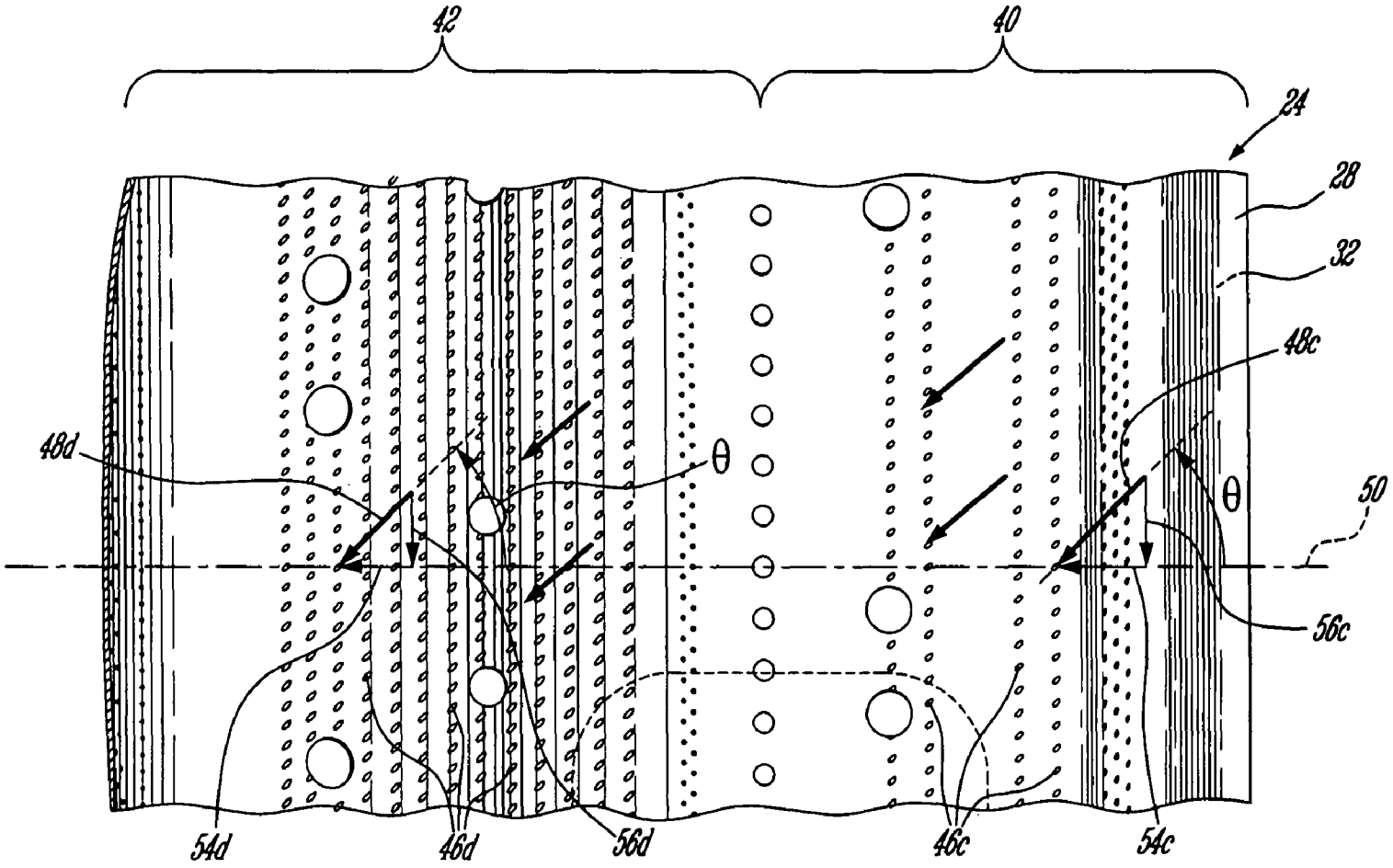
FIG. 3B is bottom view of a portion of an inner liner of the combustor of FIG. 2.

Referring to FIGS. 2, 3A and 3B, the inner and outer liners 24, 26 have a plurality of effusion holes 46*a,b,c,d* defined therethrough, through which the airflow within the gas generator case 22 enters the annular enclosure 36. Each effusion hole 46*a,b,c,d* defines a hole direction 48*a,b,c,d*, extending along a central axis of the hole and directed toward the enclosure 36. The hole direction 48*a,b,c,d* of each effusion hole 46*a,b,c,d* thus also corresponds to the general direction of the velocity of the airflow flowing through that hole 46*a,b,c,d*. In order to characterize the hole directions 48*a,b,c,d*, an imaginary radial plane 50 is defined for each effusion hole 46*a,b,c,d*, extending radially from the central axis 52 (see FIG. 2) of the combustor 16 and intersecting the corresponding effusion hole 46*a,b,c,d*, this radial plane 50 being shown for some of the effusion holes 46*a,b,c,d* in FIGS. 3A-3B and corresponding to the plane of the Figure for the effusion holes 46*a,b,c,d* depicted in FIG. 2.

The hole direction 48*a,b,c,d* of each effusion hole 46*a,b,c,d* extends at an acute angle with respect to the corresponding liner 24, 26, the projection β of that angle on the corresponding radial plane 50 being shown in FIG. 2. The projected angle β of each angled effusion hole 46*a,b,c,d* is thus defined as the angle measured from the corresponding liner 24, 26, for example the outer surface 28, 30 thereof, to the projection of the hole direction 48*a,b,c,d* on the corresponding radial plane 50.

The hole direction 48*a,b,c,d* of each effusion hole 46*a,b,c,d* also extends at an acute angle with respect to the corresponding radial plane 50, the projection 0 of that angle on the outer surface 28, 30 of the corresponding liner 24, 26 being shown in FIGS. 3A-3B. The projected angle θ of each angled effusion hole 46*a,b,c,d* is thus defined as the angle measured from the corresponding radial plane 50 to the projection of the hole direction 48*a,b,c,d* on the outer surface 28, 30 of the corresponding liner 24, 26.

Preferred values for the projected angles β define angles between the hole directions 48*a,b,c,d* and the corresponding outer surface 28, 30 of between 20° and 30°, and the projected angles θ are preferably defined between 30° and 90° and most preferably approximately 45°. Streamwise and spanwise distances between adjacent effusion holes 46*a,b,c,d* (shown respectively at x and y in FIGS. 3A-3B) is preferably between 2 to 5 times the effusion hole diameter. The diameter of the effusion holes 46*a,b,c,d* is preferably between 0.018 and 0.035 inches depending on the engine application, size of the combustor 16 and thickness of the liners 24, 26, with preferred values of approximately 0.020 inches for the effusion holes 46*a,c* defined in the primary section 40 and approximately 0.030 inches for the remaining effusion holes 46*b,d* in order to reduce manufacturing time and cost.

Referring to FIGS. 2, 3A and 3B, a longitudinal component 54*a,b,c,d* is defined for each angled hole direction 48*a,b,c,d*, extending tangentially to the corresponding liner inner surface 32, 34 and in the radial plane of the hole. The longitudinal component 54*a,b,c,d* of each angled hole direction 48*a,b,c,d* generally corresponds to a longitudinal component of the direction of the velocity of the airflow coming through the corresponding effusion hole 46*a,b,c,d*.

In a particular embodiment and in order to complement the gas flow within the combustor 16, the longitudinal component 54*a* of each effusion hole 46*a* defined in the outer liner 26 in the primary section 40 is directed away from the downstream section 42, while the longitudinal component 54*c* of each effusion hole 46*c* defined in the inner liner 24 in the primary section 40 is directed toward the downstream section 42. For both liners 24, 26, the longitudinal component 54*b,d* of each effusion hole 46*b,d* defined in the downstream section 42 is directed away from the primary section 40. As such, the effusion holes 46*a,b,c,d* are angled following the direction of the airflow coming out of the diffuser 20, which is illustrated by arrows 58, 60 in FIG. 2.

Referring to FIGS. 3A-3B, a tangential component 56*a,b,c,d* is also defined for each angled hole direction 48*a,b,c,d*, extending tangentially to the corresponding liner inner surface 32, 34 and perpendicularly to the central axis 52 of the combustor 16. The tangential component 56*a,b,c,d*, of each angled hole direction 48*a,b,c,d* generally corresponds to a tangential component of the direction of the velocity of the airflow coming through the corresponding effusion hole 46*a,b,c,d*.

Also in order to complement the gas flow within the combustor 16, the tangential component 56*a,b,c,d* of each effusion hole 46*a,b,c,d* is directed along a same rotational direction for all the effusion holes 46*a,b,c,d* defined in the combustor 16. This same rotational direction corresponds to the rotational direction of the combustion gases already swirling in the combustor 16. In the embodiment shown, this same rotational direction is the clockwise direction when examined from the viewpoint of arrow A in FIG. 2.

Effusion holes 46*a,b,c,d* having a longitudinal component 54*a,b,c,d* and/or a tangential component 56*a,b,c,d* with a different orientation than those described above are also considered, depending on the characteristics of the flow within the combustor 16. For example, a first series of effusion holes oriented to complement the flow within the combustor 16 as described above can be used in combination with a second series of effusion holes oriented partially or totally against the flow within the combustor while reducing the noise emissions thereof as will be further detailed below.

The effusion holes 46*a,b,c,d* attenuate the broadband low frequency range of noise generated by the compressed air delivered to the combustor 16 from the compressor 14 and/or the noise generated or amplified by the combustor 16 which propagates to other parts of the engine 10. This noise attenuation effect is obtained through a shift of phase between the noise from the compressor 14 and the noise from the combustor 16 as well as through a reduction in the amplitude of the combustor noise emissions.

The number and size of the effusion holes 46*a,b,c,d* define a relative effusion open area Ac for each portion of the combustor 16 being considered (e.g. the entire combustor 16 or part or all of one or both of the sections 40, 42). This relative open area Ac is simply defined by the ratio of the total area of the effusion holes 46*a,b,c,d* defined in the portion of the combustor 16 being considered, AhO,S, over the area of the combustor 16 in that portion (i.e. the corresponding part of the liner outer surface(s) 28, 30), $A_{combustor}$:

$$Ac = \frac{A_{holes}}{A_{combustor}}$$

The relative open area Ac of each combustor portion considered defined by the corresponding effusion holes 46*a,b,c,d* is used to define a geometrical parameter, the transparency coefficient $\tau_c$, which is defined for each portion as follows:

$$\tau_c = \frac{0.04(\%\,Ac)}{\pi t a^2} \text{ with } a = b - d$$

where % Ac is the percentage corresponding to the relative open area Ac, i.e. % Ac=100*Ac, t is the thickness of the corresponding liner(s) 24, 26, a is the shortest distance between adjacent effusion holes 46*a,b,c,d*, b is the distance between adjacent effusion holes 46*a,b,c,d* measured from center to center and d is the diameter of the effusion holes 46*a,b,c,d*, with t, a, b and d being defined in inches.

The reduction of noise amplitude mentioned above, or noise attenuation effect, of the effusion holes 46*a,b,c,d* on the combustor 16 is reflected by a relationship between the noise frequencies that are attenuated by the air coming through the effusion holes 46*a,b,c,d* and the geometry (hole diameter d, hole spacing a) of these effusion holes 46*a,b,c,d*. This relationship can be established using the transparency index $\tau_c$ set forth above. Namely, a curve can be developed for the attenuation at various ranges of frequencies $f_a$ by using the following equation:

$$f_a = C_1 \log\log(\tau_c) + C_2(\Delta\tau_c) + C_3$$

where $C_1$, $C_2$ and $C_3$ are constants for each range of attenuated frequencies $f_a$. The constants $C_1$, $C_2$ and $C_3$ can be experimentally evaluated, for example by measuring the frequency ranges imposed on an engine core (e.g. using microphones and/or pressure transducers) of an engine simultaneously fitted with various combustors, each combustor having effusion holes defined therein which correspond to a specific and different transparency index $\tau_c$. From the results, the constant $C_1$, $C_2$ and $C_3$ can be extrapolated.

Thus, by varying the size and distribution of the effusion holes 46*a,b,c,d* (thus varying the transparency index $\tau_c$), a specific range of frequencies $f_a$ to be attenuated can be targeted, for example a range of 0-20 kHz.

Most of the reaction between fuel and air in the combustor 16 happens in the primary section 40 where the majority of the heat is released. Thus the primary section 40 is most susceptible to generate any frequencies $f_a$ to be attenuated, for example through the compressor flow, the fuel nozzle feed pressure for both air and fuel and/or the heat release of the combustion process. Any perturbation can also bring the structure of the combustor 16 into a similar mode as the frequencies generated by other parts of the engine 10, thus amplifying these frequencies $f_a$ to be attenuated, starting immediately at the primary section 40 where the combustion takes place. An increased density of effusion holes 46*a,b* defined in the primary section 40 helps in absorbing some of the energy generated by the frequencies $f_a$ to be attenuated. However a too high density of effusion holes 46*a,b* defined in the primary section 40 can produce undesirable effects by quenching the combustion products near the region of the liner inner surfaces 32, 34, thus leading to higher carbon monoxide (CO) and unburnt hydrocarbon (UHC) levels, which in turn lead to lower combustion efficiency and higher engine specific fuel consumption (SFC).

The density of the effusion holes 46*a,b,c,d* determines the static and dynamic pressures redistributions that act as energy dissipaters to reduce the sound power level (amplitude). Thus, better suppression of the desired attenuated frequencies $f_a$ is achieved with a ratio between the hole density in the primary section 40 and in the downstream section 42 equal to or greater than 1. In other words, since an increased sound attenuation is desirable in the primary section 40, the density of the effusion holes 46*a,c* defined in the primary section 40 is at least equal, and preferably greater, than the density of the effusion holes 46*b,d* defined in the downstream section 42.

Figure 4:
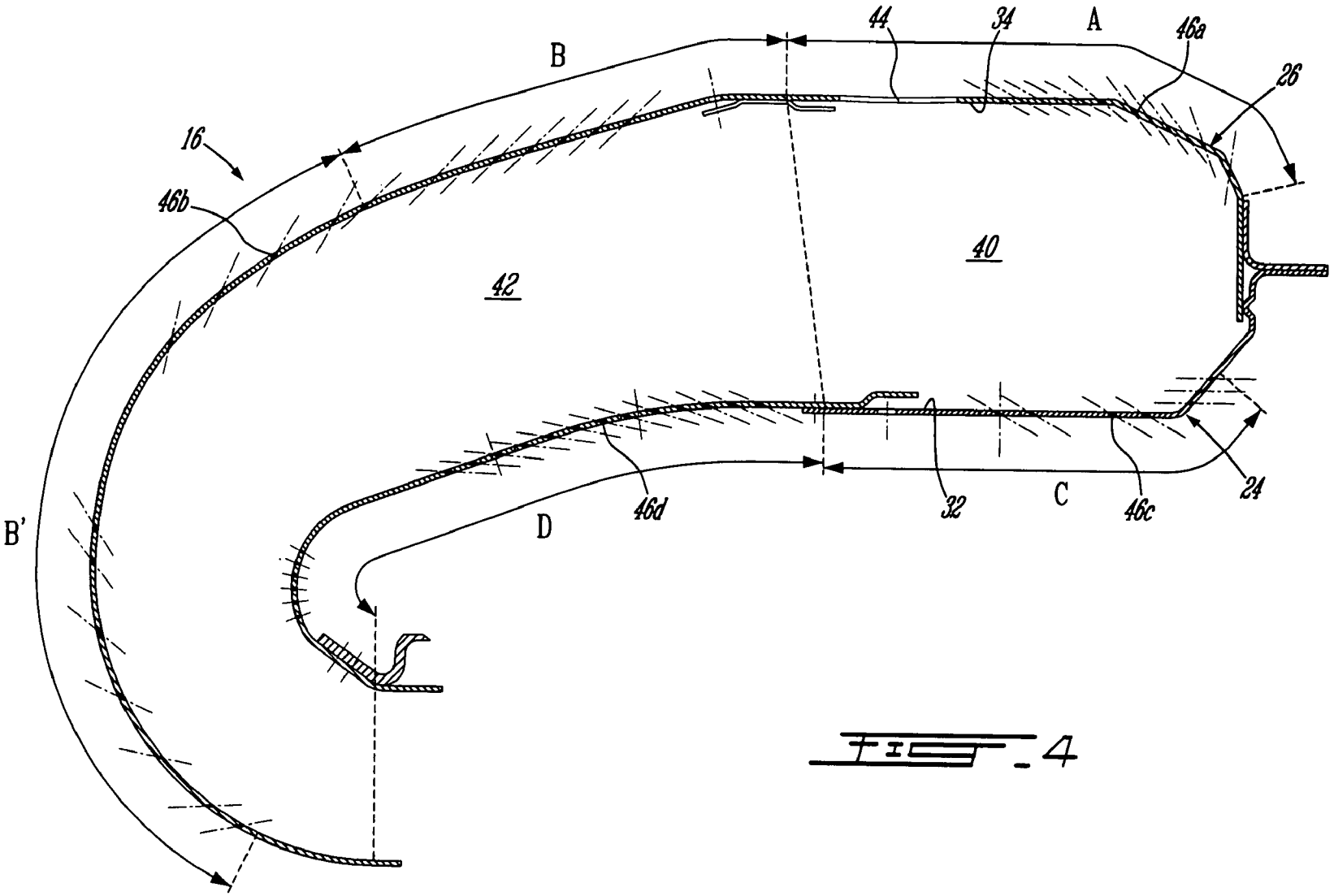
FIG. 4 is a cross-sectional view of the combustor of FIG. 2, identifying different regions and sections thereof.

Referring to FIG. 4, the outer liner 26 is shown as being divided in three regions, namely region A located in primary section 40 and regions B and B' located in downstream section 42, while the inner liner 24 is shown as being divided in two regions, namely region C located in the primary section 40 and region D located in the downstream section 42. The preferred relationship between the hole densities in these different regions is thus defined as:

$$\frac{n_{A+C}}{n_{B+B'+D}} \geq 1$$

Where $n_{A+C}$ is the mean hole density over regions A and C (i.e. the primary section 40) and $n_{B+B'+D}$ is the mean hole density over regions B, B' and D (i.e. the downstream section 42). As mentioned above, the maximum value for the density of the effusion holes 46*a,c* defined in the primary section 40 (i.e. $n_{A+C}$) is determined based on conditions producing a quenching of the combustion products near the combustor inner surfaces 32, 34 which would produce engine starting problems.

Moreover, the geometry of the effusion holes 46*a,b,c,d* defined in each portion of the combustor 16 being considered (e.g. entire combustor 16 or part or all of the section(s) 40, 42) determines a discharge coefficient Cd for that portion. Each discharge coefficient Cd has a value between 0 (total blockage) and 1 (fully open). Each discharge coefficient Cd depends on the approach velocity of the airflow but also on flow blockage and restriction, i.e. the number, size and shape of the corresponding effusion holes 46*a,b,c,d* (e.g. l/d where l is the length of the hole and d is the mean diameter, the length l being influenced by the projected angles θ, β). Each discharge coefficient Cd thus defines an effective open area ACd for the considered portion of the combustor 16 which is simply defined as:

$$ACd = A_{combustor} * Cd$$

The effective open area ACd is thus related to the dynamic flow of the air through the effusion holes 46*a,b,c,d*, and is used to calculate the combustor pressure drop AP across the combustor wall 24, 26 according to the following:

$$ACd = \frac{\dot{m}}{\sqrt{2\rho\Delta P}}$$

where m is the air mass flow rate and ρ is the air density.

The shift of phase between noise from the compressor 14 and noise from the combustor 16 mentioned above is illustrated by a time delay $T_{delay}$ imposed on the low frequency vibrations generated by the compressor 14 with respect to the noise generated by the combustion process in the combustor 16. This time delay $T_{delay}$ is imposed by the deflection of the air entering the angled effusion holes 46*a,b,c,d*, along two directions (projected angles β,θ). The double angle (β,θ) of the effusion holes 46*a,b,c,d* shifts the noise from the compressor 14 along two directions which reduces the likelihood that it will be coupled with the noise from the combustor 16. Accordingly, the time delay $T_{delay}$ produces a decoupling effect on the noise from the compressor 14 and the combustor 16, thus further reducing the noise emissions of the engine 10.

Experiments have shown that the time delay $T_{delay}$ producing that decoupling effect is a function of the following parameters:

$$T_{delay}=f[(x/d),(y/d),\Delta P_{local},(\theta/\beta)]$$

where x is the streamwise distance between adjacent effusion holes 46*a,b,c,d* (shown in FIGS. 3A-3B), y is the spanwise distance between adjacent effusion holes 46*a,b,c,d* (shown in FIGS. 3A-3B), d is the diameter of the effusion holes 46*a,b,c,d*, $\Delta P_{local}$ is the pressure differential across the combustor liner 24, 26 for the combustor portion considered (which is a function of ACd as described above), β is the projected angle of the hole direction 48*a,b,c,d* to the corresponding outer surface 28, 30 and θ is the projected angle of the hole direction 48*a,b,c,d* to the respective radial plane 50.

The decoupling time delay $T_{delay}$ is specific for each section 40, 42 of the combustor 16. However, as explained above, as most of the reaction between fuel/air happens in the primary section 40 where the majority of the heat is released, the decoupling time delay $T_{delay}$ corresponding to primary section 40, where the combustion process is initiated and the flame front stabilises, is the one that is preferably controlled.

Thus, the angle ratio θ/β is mainly responsible for creating the time delay $T_{delay}$, which produces the frequency phase shift causing the decoupling action between the noise of the compressor 14 and of the combustor 16. The decoupling time delay $T_{delay}$ is also a function of the geometrical arrangement of the combustor holes (x,y,d), and of the pressure drop ($\Delta P_{local}$) across the combustor liners 24, 26 which is a measure of the intensity of the turbulence of the airflow and which is related to the geometry of the effusion holes through its relation to the effective open area ACd, as described above.

Accordingly, the exact size and configuration of the effusion holes 46*a,b,c,d* producing the optimal noise reduction depends on many factors, including engine design conditions and application. For a specific engine and combustor geometry, the hole density (distances x,y) and hole diameter d are selected according to one or both the desired decoupling time delay $T_{delay}$ and the desired attenuated frequencies $f_a$, particularly in the primary section 40 as detailed above. The projected angles β,θ are also selected according to the desired decoupling time delay $T_{delay}$ as detailed above. The geometry (density, size, angles) of the effusion holes 46*a,b,c,d* is thus determined according to the desired decoupling time delay $T_{delay}$ and attenuated frequencies $f_a$.

Experimental work is used to determine the most effective effusion hole pattern for a given engine 10. The noise emissions of the engine 10 are measured, for example by using a number of pressure transducers (PCB probes) installed on various parts of the engine 10. These PCB probes include straight lead-tube (approximately 10") between the measurement location and the probe as well as an approximately 100 ft long closed-end wave-guide. All connected tubes are of the same internal diameter corresponding to the PCB probe diameter. Microphones are also installed outside the engine 10 at two different locations to measure the frequency radiated by the compressor 14 and the resultant frequency ranges in the turbine section 18 and/or the engine exhaust, such as to provide a comparison with the PCB probes measurement. Through the PCB probes and microphones, the frequency ranges generated and/or imposed by various components of the engine 10 is determined, and the source of attenuation of the frequencies is differentiated, whether inside or outside the combustor 16. A multi-channels recording system can be utilised to allow for real time data visualization. The frequency response of the PCB probes and microphones (Phase and Amplitude) is determined.

Once the frequency characteristics of the engine are known, the transparency coefficient $\tau_c$ (through the size and density of the effusion holes 46*a,b,c,d*) and the angles β, θ are manipulated as detailed above to achieve the required sound attenuation and noise reduction for the specific size and shape of a particular combustor 16.

The double orientation effusion holes 46*a,b,c,d* thus produce a noise attenuation effect on the engine 10 by producing a shift of phase between the noise from the compressor 14 and the noise from the combustor 16 as well as by reducing the amplitude of the combustor noise. An increased density of effusion holes 46*a,c* in the primary section 40 allow for an increased noise attenuation effect in the primary section 40, which is more susceptible to both generate and amplify noises having a frequency requiring attenuation. The noise attenuation of low frequency ranges brought by the double orientation effusion holes 46*a,b,c,d* allows for a reduction of the far field noise emission level of the engine 10, especially in cases where the engine 10 is an APU.

The above description is meant to be exemplary only, and one skilled in the art will recognize that changes may be made to the embodiments described without department from the scope of the invention disclosed. Other modifications which fall within the scope of the present invention will be apparent to those skilled in the art, in light of a review of this disclosure, and such modifications are intended to fall within the appended claims.

What is claimed is:

1. A combustor for a gas turbine engine, the combustor comprising inner and outer liners defining an annular combustion chamber therebetween and joined by a combustor dome, the combustion chamber having a primary section adapted to receive a plurality of fuel nozzles and a secondary section defined downstream of the primary section, the inner and outer liners having a plurality of angled effusion holes defined therethrough in the primary and secondary sections, at least some of the effusion holes in the primary section being located between the fuel nozzles and the combustor dome, wherein a diameter of the effusion holes defined in the primary section is smaller than a diameter of all the effusion holes defined in the secondary section, each of the effusion holes being defined through a corresponding one of the liners at a first non-zero angle with respect to a surface of the corresponding one of the liners and at a second non-zero angle with respect to a corresponding radial plane extending radially from a central axis of the combustor, a density of the effusion holes defined in the primary section being greater than a density of the effusion holes defined in the secondary section.

2. The combustor as defined in claim 1, wherein the first angle has a value of between about 20 and 30 degrees.

3. The combustor as defined in claim 1, wherein a projection of the second angle on an outer surface of the corresponding one of the inner and outer liners has a value of between about 30 and 90 degrees.

4. The combustor as defined in claim 3, wherein the projection of the second angle has a value of approximately 45 degrees.

5. The combustor as defined in claim 1, wherein the diameter of the effusion holes defined in the primary section is approximately 0.020 inches.

6. The combustor as defined in claim 1, wherein the diameter of the effusion holes defined in the secondary section is approximately 0.030 inches.

7. The combustor as defined in claim 1, wherein each of the effusion holes has a hole direction defined along a central axis thereof and toward the combustion chamber, the hole direction of each of the effusion holes having a tangential component defined tangentially to a corresponding one of the inner and outer liners and perpendicularly to the central axis of the combustor, the tangential component of all of the effusion holes corresponding to a same rotational direction with respect to the central axis of the combustor.

* * * * *